US005735043A

United States Patent [19]

Schmidt et al.

[11] Patent Number: 5,735,043

[45] Date of Patent: Apr. 7, 1998

[54] METHOD FOR MOUNTING AND FINISHING VALVE SEAT RINGS PRE-MANUFACTURED BY POWDER METALLURGICAL METHOD TECHNIQUES

[75] Inventors: Holger Schmidt, Wuppertal; Gerd Krüger, Wetter, both of Germany

[73] Assignee: Bleistahl Produktions- GmbH & Co. KG, Wetter/Ruhr, Germany

[21] Appl. No.: 623,488

[22] Filed: Mar. 28, 1996

[30] Foreign Application Priority Data

Mar. 28, 1995 [EP] European Pat. Off. ..... 95 104 535.0

[51] Int. Cl.[6] ..... B23P 11/00

[52] U.S. Cl. ..... 29/888.44; 29/90.01; 29/888.061

[58] Field of Search ..... 29/888.44, 888.4, 29/888.42, 888.06, 888.061, 890.122, 90.01

[56] References Cited

U.S. PATENT DOCUMENTS

| | | | |
|---|---|---|---|
| 1,999,434 | 4/1935 | Albertson | 29/888.44 |
| 2,008,002 | 7/1935 | Calkins | 29/888.44 |
| 2,121,464 | 6/1938 | Zagorski | 29/888.44 |
| 4,227,292 | 10/1980 | Kipling | 29/402.04 |
| 5,653,377 | 8/1997 | Reatherford et al. | 29/888.44 |
| 5,659,937 | 8/1997 | Santi | 29/888.44 |

FOREIGN PATENT DOCUMENTS

| | | | |
|---|---|---|---|
| 57-146437 | 9/1982 | Japan | 29/888.06 |
| 963835 | 10/1982 | U.S.S.R. | 29/888.06 |

OTHER PUBLICATIONS

"Baublies"; Roller burnishing tools.

*Primary Examiner*—Erick R. Solis

*Attorney, Agent, or Firm*—Robert W. Becker & Associates

[57] ABSTRACT

In a method for mounting and finishing a valve seat ring in an operational position of a receiving bore at the entrance of a gas channel of the cylinder head of an internal combustion engine consisting of a light alloy, an annular body with a central opening is manufactured by powder pressing and sintering. A roller burnishing tool is positioned within the central of the annular body. The annular body is inserted into the receiving bore with the aid of the roller burnishing tool such that the annular body is positioned with play relative the inner wall of the receiving bore. The annular body is radially expanded by roller burnishing with the roller burnishing tool such that the annular body positive-lockingly engages the inner wall of the receiving bore and is compressed to a selected finish size of ready-to-use density.

8 Claims, 2 Drawing Sheets

METHOD FOR MOUNTING AND FINISHING VALVE SEAT RINGS PRE-MANUFACTURED BY POWDER METALLURGICAL METHOD TECHNIQUES

BACKGROUND OF THE INVENTION

The present invention relates to a method for mounting and finishing valve seat rings pre-manufactured by powdered metallurgical techniques in their operational position in a receiving bore at the entrance of a gas channel within the cylinder head of an internal combustion engine consisting of light metal alloys, for example, aluminum alloys.

Powder-metallurgically pre-manufactured valve seat rings have been known for many years. They are suitable for cylinder heads of spark-ignition engines operated with leaded and unleaded fuels as well as for natural gas and diesel engines. The ready-for-use (operational) density which is required for a minimal wear operation is produced by axial pressing. The thus pre-manufactured valve seat rings must subsequently be ground in complicated process in order to be shrink-fit with minimal dimensional tolerances into a bore of a cylinder head. Even after mounting further cutting operations are required. In these cutting operations the valve seat, and subsequently, the transition of the valve seat ring into the gas channel are machined.

The known techniques for manufacturing and mounting valve seat rings made by powder-metallurgical techniques is time-consuming and cost-intensive. The pressing tool which are required include a great plurality of tool parts. Furthermore, for a relatively high number of different operational steps, many handling operations are required and during the sequence of individual steps only few possibilities for simplifying or improving the process are provided in order to achieve a considerable cost reduction.

It is therefore an object of the present invention to provide a method for manufacturing and mounting valve seat rings which is substantially simplified, primarily, with respect to a reduction of the required manufacturing time period and with respect to considerable saving of manufacturing costs.

SUMMARY OF THE INVENTION

The inventive method for mounting and finishing a valve seat ring in an operational position of a receiving bore at the entrance of a gas channel of a cylinder head of an internal combustion engine, consisting of a light alloy, according to the present invention is primarily characterized by:

- manufacturing an annular body with a central opening by powder pressing and sintering;
- positioning said annular body with said central opening on a head of a roller burnishing tool;
- inserting the annular body with the aid of the roller burnishing tool into the receiving bore such that the annular body is positioned with play relative to an inner wall of receiving bore; and
- radially expanding the annular body by roller burnishing with a roller burnishing tool such that the annular body positive-lockingly engages the inner wall of the receiving bore and is compressed to a selected finish size of ready-to-use density in order to form the valve seat ring.

Preferably, the step of radially expending includes the step of providing the roller burnishing tool with a first set of rollers having a cylindrical envelope.

Advantageously, the step of radially expanding includes the step of roller burnishing a transition zone of the valve seat ring into the gas channel.

Expediently, the step of radially expanding includes the step of providing the roller burnishing tool with a second set of rollers having a conical envelope and further compressing with the second set of rollers a inner free edge of the annular body to form a valve seat of the valve seat ring with a preset angle of 45° to 60°.

In a preferred embodiment of the present invention the step of radially expanding includes the step of providing the roller burnishing tool with a second set of profiled rollers and further compressing with the second set of profiled rollers the annular body to form a valve seat and auxiliary valve seat of the valve seat ring.

Expediently, the step of radially expanding includes the step of providing the roller burnishing tool with a set of profiled roller for compressing the annular body to the desired finish size.

Advantageously, the step of radially expanding includes the step of forming an inner mantle surface at the valve seat ring projecting inwardly relative to the inner wall of the receiving bore.

Preferably, the step of radially expanding includes the step of friction welding the annular body to the receiving bore by continuing rotation of the annular body with the roller burnishing tool after the annular body has contacted the annular wall of the receiving bore, whereby the resulting frictional heat causes friction welding.

In contrast to known methods of the art in the inventive method the pre-manufactured annular body is compressed with the aid of a known roller burnishing tool during mounting within the receiving opening of the cylinder head by radial expansion to the finish size at operational density. The main advantages of such a method are: fewer machining steps are required during manufacture and mounting, less material is used, and the cost are considerably reduced. Further advantages will be explained in the following.

According to the inventive method, the pre-manufactured annular body is first fed with the roller burnishing tool into the receiving opening and is subsequently expended. In many cases, in which the finished valve seat ring is flush with the inner mantle surface of the inner wall of the gas channel, the annular body is inventively compressed to the desired finish size of the cylindrical inner wall surface of the gas channel with a set of rollers having a cylindrical envelope. The roller burnishing step is carried out by rotating and simultaneously spreading the rollers connected to the periphery of the tool by advancing the cone of the roller burnishing tool. The expansion secures the annular body in the receiving opening by a positive locking action. Simultaneous to the compression step, the transition of the valve seat ring into the gas channel is also machined by roller burnishing.

According to another advantageous embodiment of the invention, with a second set of rollers having a conical envelope of the roller burnishing tool, the free inner edge of the annular body is formed into a valve seat of a preset angle of, for example, 45° or 60° by roller burnishing and simultaneous further compression of the material of the annular body. In this step it is also possible to form auxiliary valve seat surfaces by roller burnishing. During the generation of the valve seat and auxiliary valve seat the valve seat ring is provided in this area with the required operational density.

The inventive method has the further advantage that in a manner which is simpler than the prior art methods the valve seat rings are producible with a continuous inner mantle surface whereby this mantle surface may project relative to the inner wall of the gas channel. For this purpose, according to the present invention, a roller burnishing tool with a set of rollers having profile roller is used and the pre-manufactured valve seat ring, after positioning in the receiving bore, is first expended and, in the same method step is compressed to the desired finish size with the desired contoured inner mantle surface.

Another advantageous embodiment of the invention it is suggested that the pre-manufactured annular body during radial expansion is further rotated, even after contacting the inner wall of the receiving bore, such that due to the produced heat the parts are subjected to friction welding.

In addition to the aforementioned advantages, the invention has further important advantages such as: reduced material usage, no need for disposing of cuttings, the cylinder head must not be heated, the valve seat rings must not be cooled and the roller burnishing method, in comparison to machining by cutting produces surfaces of high supporting action.

In the manufacture of fittings roller burnishing tools have already been employed for mounting seating rings made of steel. In this method, a seating ring, which with respect to its ready-to-use state is already completed, is fitted by radial expansion into the bore of a fitting. Further finishing operations of the steel ring with regard to compressing or forming are not preformed.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention, will now be described in detail with the aid of several specific embodiments utilizing FIGS. 1 through 6.

Figure 1:
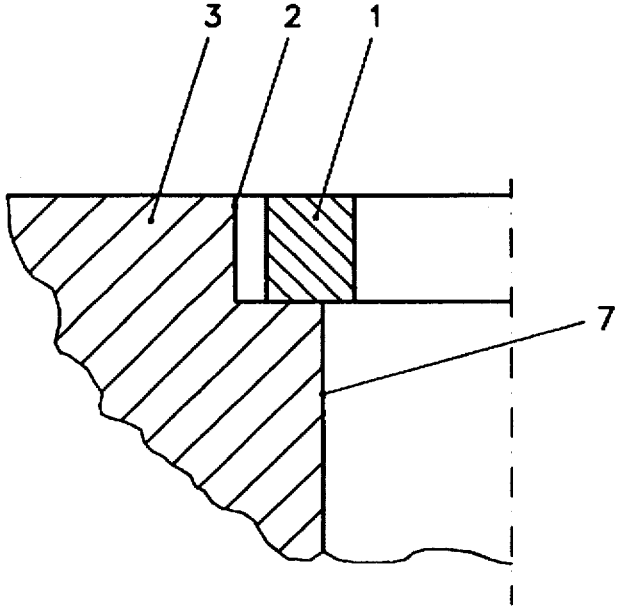
FIG. 1 shows an inserted annular body before expansion.

FIG. 1 illustrates a pre-manufactured annular body 1 within a receiving bore 2 of a cylinder head 3 before further machining. The annular body 1 is advanced into the receiving bore 2 with the aid of a known roller burnishing tool which is not shown in FIG. 1. The annular body 1 is secured at the roller burnishing tool by radially expanding the cone with the rollers.

Figure 2:
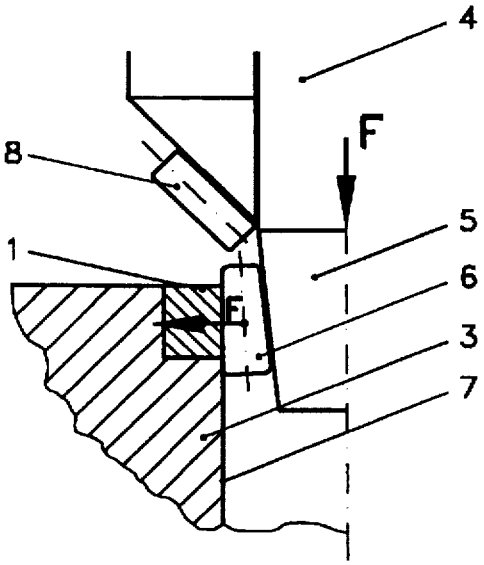
FIG. 2 shows a roller burnishing tool in connection with an expanded valve seat ring.
Figure 3:
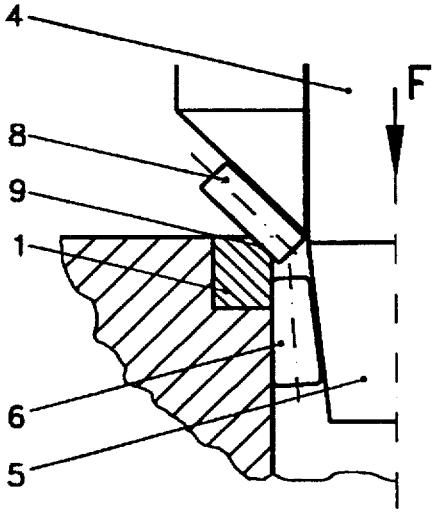
FIG. 3 shows a further operating position of the roller burnishing tool of FIG. 2.

In FIG. 2 the annular body 1 is shown in the expanded state and already compressed to the finish size. The head of the roller burnishing tool 4 with cone (head) 5 is represented. The cone 5 at its periphery is provided with a set of rollers 6 having a cylindrical envelope. The roller burnishing step is preformed by rotation of the tool 4 and simultaneously spreading the rollers 6 positioned at the circumference of the tool by adjusting the cone 5. The expansion causes the annular body 1 to achieve positive locking within the receiving bore 2. After completion of expanding the transition of the annular body 1 into the gas channel 7 is machined further.

The mounting of the annular body 1 can also be preformed as follows. With a respective control of the cone 5 an initial further rotation of the annular body 1 at the beginning of contacting of the annular body 1 at the inner wall of the receiving bore 2 may result in heating of the material of the receiving bore 2 and thus in friction welding of the annular body 1 with positive locking seat.

For the subsequent generation of the actual valve seat, the head of the roller burnishing tool is provided with a second set of rollers 8 having a conical envelope. By axially displacing the head, the second set of rollers 8 comes into contact with the free inner edge of the annular body 1. With this second set of rollers 8, the valve seat 9 is roller burnished at an angle of, for example, 45° for further compression of the material.

Figure 4:
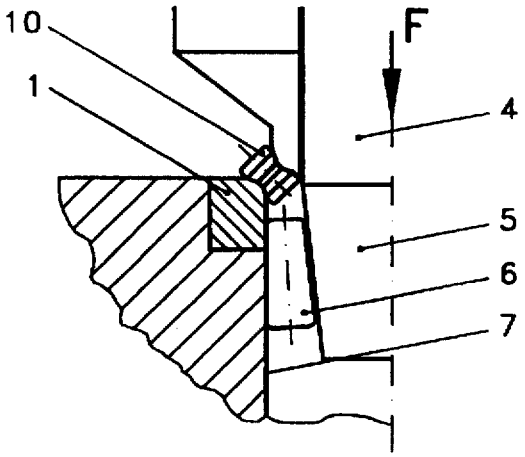
FIG. 4 shows a roller burnishing tool with a second set of profiled rollers.

FIG. 4 shows the head of the roller burnishing tool 4 in a further embodiment of the second set of rollers. The rollers 10 are profiled rollers allowing for roller burnishing the seat and auxiliary seat in one single method step.

Figure 5:
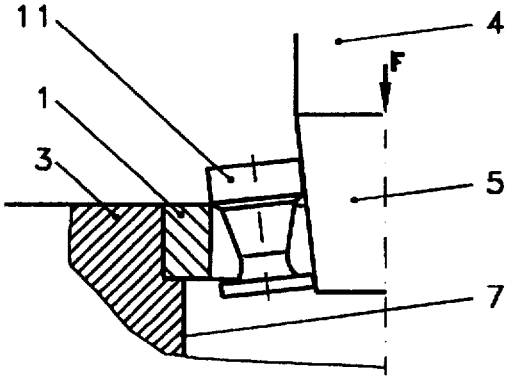
FIG. 5 shows a roller burnishing tool with a single set of profiled rollers.
Figure 6:
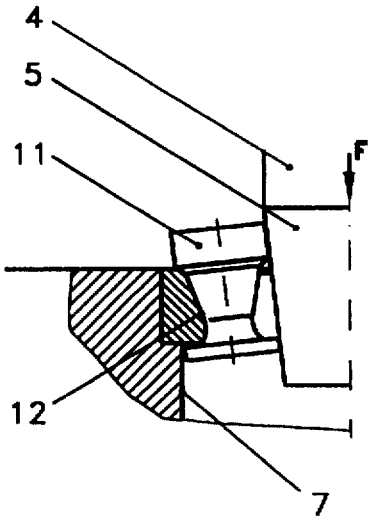
FIG. 6 shows the state of the roller burnishing tool of FIG. 5 after completion of the inventive method steps.

A further embodiment of the head of the roller burnishing tool 4 is represented in FIGS. 5 and 6. In this embodiment the rollers at the cone 5 are profiled rollers 11. The surface of the rollers 11 is designed to have a profile which after expansion of the annular body 1 forms a valve seat ring that has, relative to the inner wall of gas channel 7, a projecting contoured inner the mantle surface. The inner mantle surface 12 in the embodiment shown in FIG. 6 has a substantially funnel-shaped tapering expansion with a transition rounded at the edges is rounded. Such a valve seat ring can be compressed to the desired finish size in one single method step by roller burnishing.

The present invention is, of course, in no way restricted to the specific disclosure of the specification and drawings, but also encompasses any modifications within the scope of the appended claims.

What we claim is:

1. A method for mounting and finishing a valve seat ring in an operational position of a receiving bore at the entrance of a gas channel of a cylinder head of an internal combustion engine consisting of a light alloy, said method comprising the step of:

manufacturing an annular body with a central opening by powder pressing and sintering;

positioning said annular body with said central opening on a head of a roller burnishing tool;

inserting said annular body with the aid of said roller burnishing tool into the receiving bore such that said annular body is positioned with play relative to an inner wall of said receiving bore; and radially expanding said annular ring by roller burnishing with said roller burnishing tool such that said annular body positive-lockingly engages said inner wall of said receiving bore and is compressed to a selected finish size of ready-to-use density in order to form said valve seat ring.

2. A method according to claim 1, wherein said step of radially expanding includes the step of providing said roller burnishing tool with a first set of rollers having a cylindrical envelope.

3. A method according to claim 2, wherein said step of radially expanding includes the step of roller burnishing a transition zone of said valve seat ring into the gas channel.

4. A method according to claim 2, wherein said step of radially expanding includes the step of providing said roller burnishing tool with a second set of rollers having a conical envelope and further compressing with said second set of rollers an inner free edge of said annular body to form a valve seat of said valve seat ring with a preset angle of 45° to 60°.

5. A method according to claim 2, wherein said step of radially expanding includes the steps of providing said roller burnishing tool with a second set of profiled rollers and further compressing with said second set of profiled rollers said annular body to form a valve seat and auxiliary valve seat of said valve seat ring.

6. A method according to claim 1, wherein said step of radially expanding includes the step of providing said roller burnishing tool with a set of profiled rollers for compressing said annular body to the desired finish size.

7. A method according to claim 6, wherein said step of radially expanding includes the step of forming an inner mantle surface at said valve seat ring projecting inwardly relative to said inner wall of said receiving bore.

8. A method according to claim 1, wherein said step of radially expanding includes the step of friction welding said annular body to said receiving bore by continuing rotation of said annular body with said roller burnishing tool after said annular body has contacted said inner wall of said receiving bore whereby the resulting frictional heat causes friction welding.

* * * * *